US011542090B2

(12) United States Patent
Pidoux

(10) Patent No.: US 11,542,090 B2
(45) Date of Patent: Jan. 3, 2023

(54) SYSTEM FOR MIXING TWO COSMETIC PRODUCTS

(71) Applicant: COSMOGEN SAS, Paris (FR)

(72) Inventor: Lucie Pidoux, Lausanne (CH)

(73) Assignee: COSMOGEN SAS, Paris (FR)

( * ) Notice: Subject to any disclaimer, the term of this patent is extended or adjusted under 35 U.S.C. 154(b) by 317 days.

(21) Appl. No.: 16/677,574

(22) Filed: Nov. 7, 2019

(65) Prior Publication Data

US 2020/0071055 A1 Mar. 5, 2020

Related U.S. Application Data

(63) Continuation of application No. PCT/FR2018/051154, filed on May 9, 2018.

(30) Foreign Application Priority Data

May 9, 2017 (FR) ..... 17/54025

(51) Int. Cl.
*B65D 25/08* (2006.01)
*B65D 81/32* (2006.01)
(Continued)

(52) U.S. Cl.
CPC ..... *B65D 81/3211* (2013.01); *A45D 34/04* (2013.01); *A45D 2034/005* (2013.01);
(Continued)

(58) Field of Classification Search
CPC ..... B65D 51/2814; B65D 81/3211; B65D 81/3255; B05B 11/0078; A45D 34/04;
(Continued)

(56) References Cited

U.S. PATENT DOCUMENTS 4,648,532 A * 3/1987 Green ..... A61C 5/66 222/386
5,396,986 A * 3/1995 Fountain ..... A61C 5/66 206/219
5,435,076 A * 7/1995 Hjertman ..... F26B 5/06 604/416

(Continued)

FOREIGN PATENT DOCUMENTS

EP 0694483 1/1996
GB 2335179 9/1999

OTHER PUBLICATIONS

International Search Report for International Application PCT/FR2018/051154, dated Jul. 3, 2018.

*Primary Examiner* — Luan K Bui
(74) *Attorney, Agent, or Firm* — Burris Law, PLLC

(57) ABSTRACT

A system for mixing two cosmetic products includes a tubular bottle defining a first reservoir containing a first product to be mixed, a tubular cartridge defining a second reservoir containing a second product to be mixed, a retaining device suitable for retaining the cartridge on the bottle in an injection position in which the first reservoir communicates with the second reservoir via the inlet orifice of the base and the injection orifice of the cartridge, a perforator having an upper edge designed to perforate the cap that seals the inlet orifice when the cartridge occupies the injection position, and a piston that seals the lower end of the cartridge and that is axially slidably mounted between an initial bottom position and a final top position in order to push the second product through the injection orifice from the second reservoir to the first reservoir.

13 Claims, 3 Drawing Sheets

(51) Int. Cl.
*A45D 34/04* (2006.01)
*A45D 34/00* (2006.01)

(52) U.S. Cl.
CPC ..... *A45D 2200/055* (2013.01); *A45D 2200/058* (2013.01); *B65D 81/3255* (2013.01)

(58) Field of Classification Search
CPC ..... A45D 2200/055; A45D 2200/058; A45D 2034/005
USPC ..... 206/219–222; 215/238, DIG. 8; 366/130
See application file for complete search history.

(56) References Cited

U.S. PATENT DOCUMENTS 5,647,481 A 7/1997 Hundertmark et al.
5,692,644 A * 12/1997 Gueret ..... B05B 11/0083 222/129
5,884,759 A * 3/1999 Gueret ..... B65D 51/2871 222/145.5
5,908,107 A * 6/1999 Baudin ..... B65D 81/3211 215/DIG. 8
6,450,368 B1 * 9/2002 De LaForcade ..... B65D 1/04 222/145.5
6,474,861 B1 * 11/2002 De Laforcade .... B65D 81/3211 215/DIG. 8
6,655,525 B2 * 12/2003 Song ..... B65D 81/3211 215/DIG. 8
7,252,091 B1 * 8/2007 Wayne ..... A45D 34/04 132/112
9,999,540 B2 * 6/2018 Yang ..... A61F 9/0008
2006/0289316 A1 * 12/2006 Henry ..... B65D 81/3211 206/499
2013/0075287 A1 * 3/2013 Sharon ..... G06Q 30/02 206/219
2016/0166046 A1 * 6/2016 Hwang ..... A45D 34/06 206/221

* cited by examiner

SYSTEM FOR MIXING TWO COSMETIC PRODUCTS

CROSS-REFERENCE TO RELATED APPLICATIONS

This application is a continuation of International Application No. PCT/FR2018/051154, filed on May 9, 2018, which claims priority to and the benefit of FR 17/54025 filed on May 9, 2017. The disclosures of the above applications are incorporated herein by reference.

FIELD

The present disclosure relates to a system for mixing cosmetic products.

BACKGROUND

The statements in this section merely provide background information related to the present disclosure and may not constitute prior art.

There is known a type of system for mixing two cosmetic products which comprises a tubular bottle delimiting a first reservoir which contains a first product to be mixed, and a tubular cartridge delimiting a second reservoir which contains a second product to be mixed.

The first reservoir and the second reservoir are separated by a cap.

The cartridge is provided with a pump which, when actuated, perforates the cap and injects the second product into the first reservoir so as to mix the two products.

The type of system described above does not seem to allow selecting the combination of the two products to be mixed.

SUMMARY

The present disclosure provides a system for mixing two cosmetic products, the system comprises:

a tubular bottle which delimits a first reservoir which contains a first product to be mixed, the bottle extending axially along a main axis, from an upper end forming a distribution orifice, to a lower end;

a base which seals the lower end of the bottle and which comprises an inlet orifice communicating with the first reservoir, the inlet orifice being sealed by a cap;

a tubular cartridge which delimits a second reservoir containing a second product to be mixed, the cartridge extending axially along the main axis, from an upper end which forms an orifice for injecting the second product, to a lower end, characterized in that the system comprises:

a retaining device which is adapted to retain the cartridge on the bottle in an injection position in which the first reservoir communicates with the second reservoir via the base inlet orifice and the cartridge injection orifice;

a perforator which has an upper edge adapted to perforate the cap that seals the base inlet orifice when the cartridge occupies its injection position; and an injection device which seals the lower end of the cartridge and which is movably mounted axially, between a low initial position and a high final position, in order to push the second product through the cartridge injection orifice, from the second reservoir to the first reservoir.

The system according to the present disclosure allows the user to obtain a multitude of mixed products combinations, depending on the selected cartridge.

In addition, the system according to the present disclosure allows mixing products of different nature.

Indeed, the second product contained in the cartridge can be for example liquid, powder or granules.

In one form, the perforator axially surmounts the cartridge injection orifice.

Thus, two distinct elements allow perforating the cap and pushing the second product into the bottle. The forces are therefore decoupled and the performances of the system are improved.

The injection device is a piston.

According to this characteristic, the piston is slidably mounted axially, between a low initial position and a high final position, in order to push the second product through the cartridge injection orifice, from the second reservoir to the first reservoir.

Alternatively, the injection device is a flexible membrane.

In an advantageous manner, the base has a generally cylindrical shape along the main axis, from an upper end, to a lower end and is tightly and sealingly mounted on the lower end of the bottle.

According to one characteristic, the base is internal to the bottle.

The cap, in one form, is disposed at the upper end of the base such that it is not easily accessible by the user and it is not inadvertently perforated. These characteristics allow improving the security of the system.

According to another characteristic, the retaining device comprises a thread which extends around the main axis and which is formed on an outer face of the cartridge, and a complementary tapping which is formed on an inner face of the base.

According to another characteristic, the lower end of the cartridge is equipped with a drive ring which is secured in movement to the cartridge and which is provided to allow a user to screw the cartridge on the bottle base.

According to another characteristic, the ring is a breakable ring which is connected to the body of the cartridge by a plurality of radial retaining lugs which are mechanically weakened such that, after screwing the cartridge, the user can exert a torque on the ring which ruptures the retaining lugs and disengages the ring from the cartridge.

This characteristic allows releasing access to the injection device for the user.

According to another characteristic, the perforator has a shape of a beveled cylindrical segment which extends around the main axis and which is arranged on the upper end of the cartridge, in order to perforate the cap which seals the base inlet orifice.

According to another characteristic, the cartridge comprises a check valve which is associated with the cartridge injection orifice, in order to inhibit unintentional flow of the second product contained in the cartridge.

According to another characteristic, the system comprises a removable plug which is adapted to provide the sealing of the cartridge.

According to another characteristic, the distribution orifice of the bottle is equipped with a distribution device which is adapted to distribute the mixture of the first product and the second product contained in the first reservoir.

The bottle and the cartridge as previously described could be used independently of each other.

The present disclosure concerns more particularly a tubular bottle which delimits a first reservoir adapted to contain a first product to be mixed, intended to receive a tubular cartridge which delimits a second reservoir adapted to contain a second product to be mixed, the bottle extending axially along a main axis, from an upper end forming a distribution orifice, to a lower end, characterized in that it comprises an inner base which seals its lower end and which comprises an inlet orifice communicating with the first reservoir, the inlet orifice being sealed by a cap, and the base being adapted to cooperate with the cartridge.

All the characteristics relating to the bottle as described in the system for mixing two cosmetic products could be considered for the bottle independent of the cartridge, although these characteristics are not claimed.

The present disclosure also concerns a tubular cartridge intended to cooperate with a tubular bottle which delimits a first reservoir adapted to contain a first product to be mixed and comprising a base sealed by a cap, the cartridge delimiting a second reservoir adapted to contain a second product to be mixed, and extending axially along a main axis, from an upper end which forms an orifice for injecting the second product, to a lower end, characterized in that it comprises:

a perforator which has an upper edge adapted to perforate the cap of the bottle when the cartridge occupies its injection position, the perforator axially surmounting the cartridge injection orifice; and an injection device which seals the lower end of the cartridge and which is movably mounted axially, between a low initial position and a high final position, in order to push the second product through the cartridge injection orifice, from the second reservoir to the first reservoir.

All the characteristics relating to the cartridge as described in the system for mixing two cosmetic products, could be considered for the cartridge independent of the bottle, although these characteristics are not claimed.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
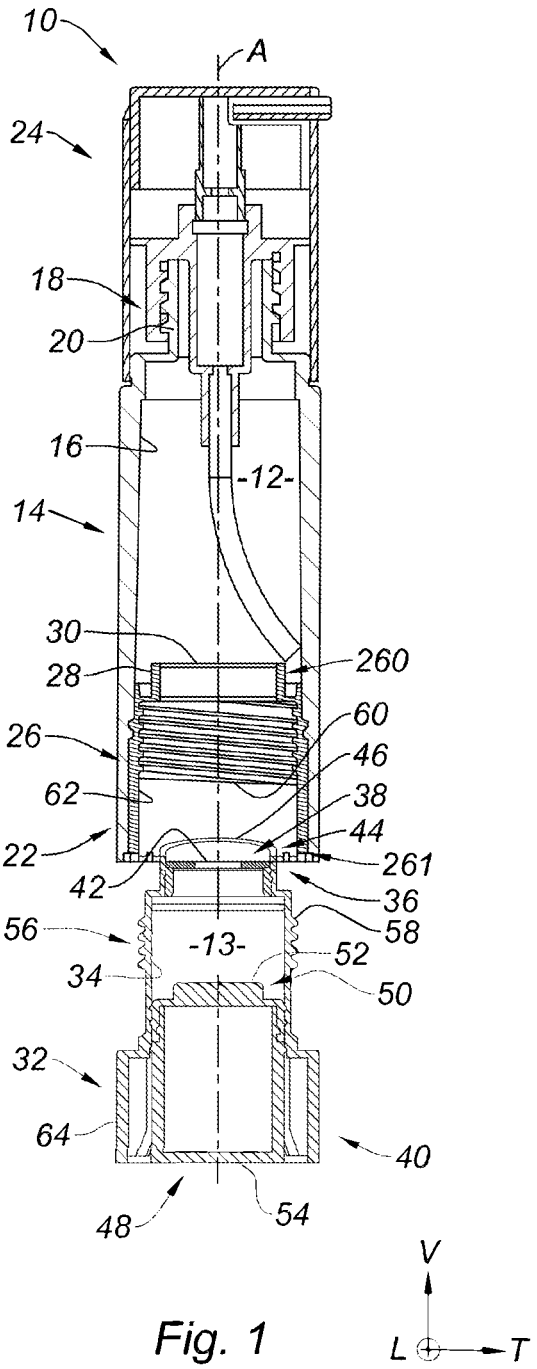
FIG. 1 is a cross-sectional view which illustrates a system for mixing two cosmetic products comprising a bottle and a cartridge shown disengaged from the bottle according to the present disclosure.

In the description and the claims, the expressions "upper," "lower," "low" and "high," and their derivatives will be used in a non-limiting manner with reference to the upper portion and to the lower portion, respectively, of FIGS. 1 to 6.

In addition, in order to clarify the description and the claims, the longitudinal, vertical and transverse terminology will be adopted in a non-limiting manner with reference to the trihedron L, V, T indicated in the figures, whose axis L is parallel to the main axis of the system.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 shows a system 10 for mixing a first cosmetic product 12, for example an active ingredient, with a second cosmetic product 13, for example a foundation.

The system 10 comprises a tubular bottle 14 which delimits a first reservoir 16 which contains the first product 12 to be mixed.

The bottle 14 extending axially along a vertical main axis A, from an upper end 18 forming a distribution orifice 20, to a lower end 22.

The bottle 14 distribution orifice 20 forms a threaded mouth on which a pump distributor 24 is screwed.

It will be understood that the type of distributor can be adapted according to the product mixture contained in the first reservoir 16, the distributor may be of the pump type or of the vaporizer type for example.

The lower end of the bottle 14 is sealed by a base 26 which has a generally cylindrical shape along the main axis A, from an upper end 260, to a lower end 261, and which is tightly and sealingly mounted on the lower end of the bottle 14.

The base 26 is internal to the bottle 14.

The circumferential dimensions of the base 26 are complementary to those of the first reservoir 16, such that it is tightly and sealingly disposed inside the bottle 14, against the first reservoir 16.

The base 26 and the bottle 14 are monolithic. They form one single piece.

The base 26 comprises an inlet orifice 28 which communicates with the reservoir 16 of the bottle 14 and which is sealed by a cap 30 disposed at its upper end 260.

The base 26 is open at its lower end 261.

The base 26 inlet orifice 28 forms a cylindrical conduit which is adapted to cooperate with a cartridge 32.

The cartridge 32 has a tubular shape which delimits a second reservoir 34 containing the second product 13 to be mixed.

The cartridge 32 extends axially along the main axis A, from an upper end 36 which forms an orifice for injecting 38 the second product 13, to a lower end 40.

The cartridge 32 injection orifice 38 forms a cylindrical conduit which is adapted to be fitted into the conduit formed by the base 26 inlet orifice 28.

Also, the injection orifice 38 is sealed by a check valve 42 which is adapted to retain the second product 13 inside the cartridge 32. The check valve 42 is for example a flexible membrane cut crosswise at its center, visible in FIG. 5.

Also, the injection orifice 38 is axially surmounted and extended by a perforator 44 which has a beveled upper edge 46 designed to perforate the cap 30 which seals the base 26 inlet orifice 28.

The cartridge 32 is equipped with a piston 48 which seals the lower end 40 of the cartridge 32 and which has a cylindrical shape along the main axis A.

The piston 48 is axially delimited by an upper face 50 which forms a bulge 52 adapted to come into contact with the check valve 42, and by a lower face which forms a bottom 54 of the cartridge 32.

Figure 2:
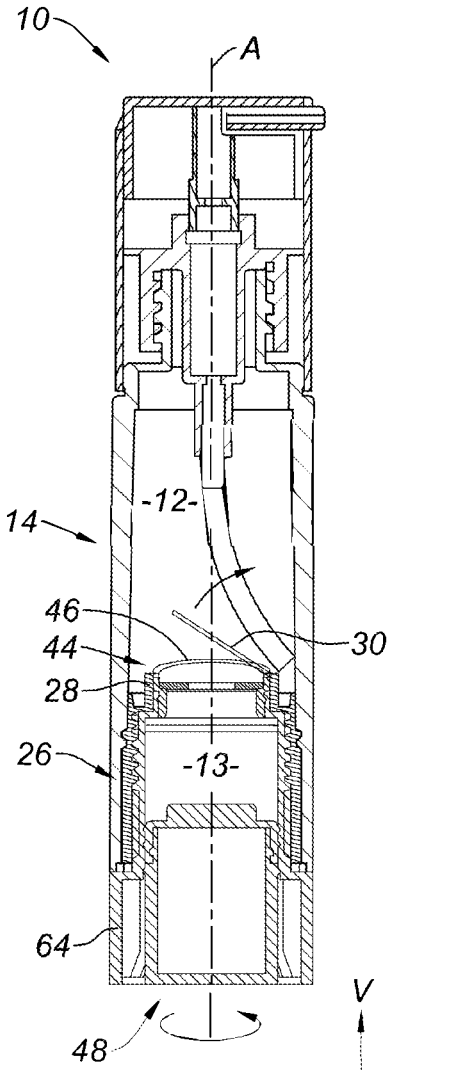
FIG. 2 is a cross-sectional view similar to the view of FIG. 1, which illustrates the cartridge in its injection position, screwed on the bottle base.
Figure 3:
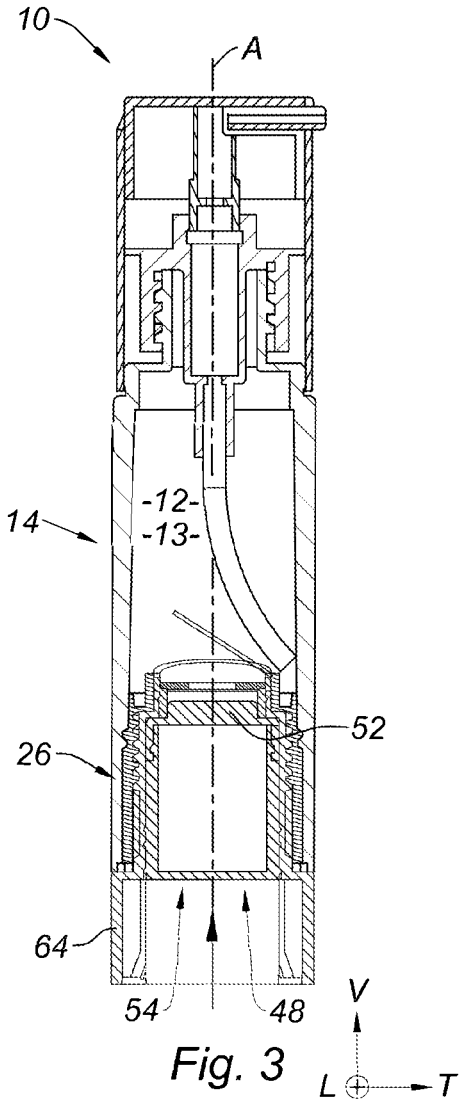
FIG. 3 is a cross-sectional view similar to the view of FIG. 1, which illustrates the piston of the cartridge in its high final position of injection.

The piston 48 is slidably mounted axially along the main axis A, between a low initial position illustrated in FIGS. 1 and 2 in which the bottom 54 of the piston 48 is flush with the lower end of the cartridge 32, and a high final position illustrated in FIG. 3 in which the bulge 52 of the piston 48 is bearing, or almost bearing, on the check valve 42.

To drive the piston 48 in sliding, in order to push the second product 13 through the cartridge 32 injection orifice 38, the user must axially push the bottom 54 of the cartridge 32 upwards.

The circumferential dimensions of the piston 48 are complementary to those of the second reservoir 34, such that it is capable of sliding in said reservoir 34 while being in contact with the inner walls of the second reservoir 34 and that it can drive the totality of the second product 13 into the first reservoir 16.

Thus, the perforator 44 is capable of displacing axially, along the main axis A, in the conduit formed by the base 26 inlet orifice 28 when the cartridge 32 is fitted into said conduit, and the piston 48 is capable of sliding axially in the cartridge 32, along the main axis A, when the user axially pushes the piston 48 upwards.

Two distinct elements allow perforating the cap 30 and pushing the second product 13 into the bottle 14. According to another aspect, the system 10 comprises a retaining device 56 which is adapted to retain the cartridge 32 on the bottle 14 in an injection position illustrated in FIGS. 2 and 3, in which the cartridge 32 is arranged so as to inject the second product 13 into the first reservoir 16 via the base 26 inlet orifice 28 and the cartridge 32 injection orifice 38.

To this end, the retaining device 56 comprises a thread 58 which extends around the main axis A and which is formed on an outer face of the cartridge 32, and a complementary tapping 60 which is formed on an inner face 62 of the base 26.

In order to screw the cartridge 32 on the base 26 of the bottle 14, the lower end 40 of the cartridge 32 is equipped with a drive ring 64 which is secured in movement with the cartridge 32.

The ring 64 has a diameter which is larger than the diameter of the upper portion of the cartridge 32 and which is substantially equal to the diameter of the bottle 14, such that the ring 64 and the bottle 14 form a uniform cylinder, as can be seen in FIG. 2.

Without limitation, the retaining device 56 may also be produced by a releasable interlocking by shape cooperation between the cartridge 32 and the base 26 of the bottle 14.

Figure 4:
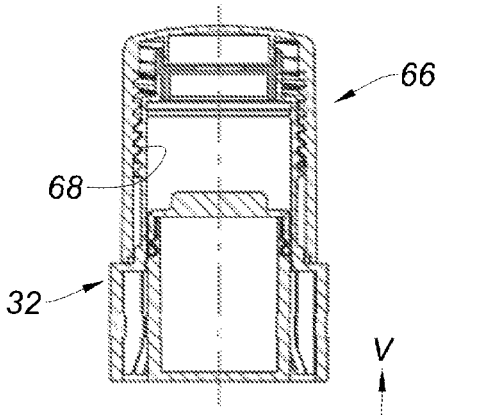
FIG. 4 is a cross-sectional detail view which illustrates the cartridge capped with a closure cap.

As can be seen in FIG. 4, the system 10 comprises a removable plug 66 which is adapted to cap the cartridge 32.

The plug 66 has a generally cylindrical skirt which comprises a tapped inner wall 68 which allows the plug 66 to be screwed and unscrewed on the cartridge 32, in order to protect the product 13 contained in the cartridge 32.

In addition, the skirt of the plug 66 provides the sealing of the cartridge 32.

An example of operation of the system 10 according to the present disclosure is described below.

The user selects a cartridge 32 according to the mixture of products that he wishes to obtain, unscrews the plug 66 then screws the cartridge 32 on the bottle 14 by the ring 64 provided to this end, as illustrated in FIG. 2.

During the screwing of the cartridge 32, the beveled upper edge 46 of the perforator 44 perforates the cap 30 which seals the inlet orifice 28 of the base 26 of the bottle 14.

The cartridge 32 occupies its injection position when the cartridge 32 is screwed until the end of the stroke, a position in which the user pushes the piston 48 from its low initial position to its high final position.

During the sliding of the piston 48, the second product 13 is injected from the cartridge 32, to the reservoir 16 of the bottle 14, through the orifices provided to this end, such that the first product 12 is mixed to the second product 13 in the reservoir 16 of the bottle 14.

After this mixing, the user actuates the pump distributor 24 which distributes the mixture of products contained in the reservoir 16 of the bottle 14.

Figure 5:
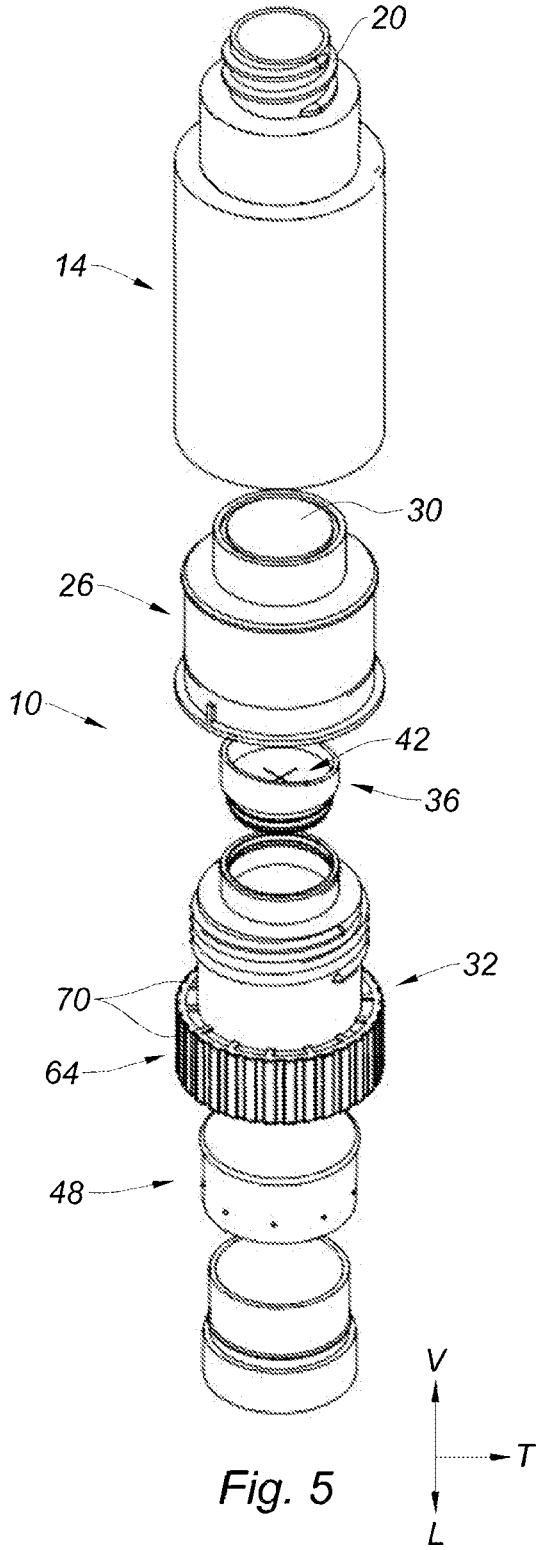
FIG. 5 is an exploded perspective view, which illustrates the system comprising a breakable drive ring according to a variant of the present disclosure.

FIG. 5 shows a variant of the system 10 according to the present disclosure, which comprises a breakable drive ring 64.

To this end, the ring 64 is connected to the body of the cartridge 32 by a plurality of radial retaining lugs 70 which are mechanically weakened such that, after screwing the cartridge 32, the user can exert a torque on the ring 64 which ruptures the retaining lugs 70.

The ring 64, once disengaged from the cartridge 32, uncovers the piston 48 in order to promote its sinking by the user.

Figure 6:
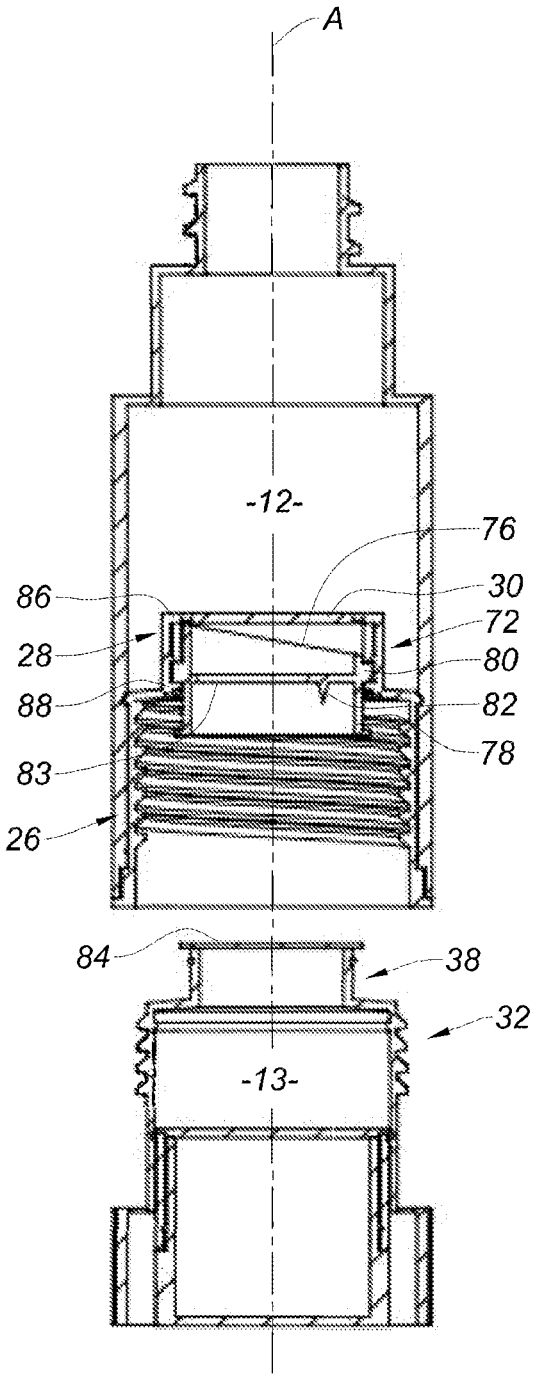
FIG. 6 is a cross-sectional view which illustrates a perforator according to a variant of the present disclosure.

Also, FIG. 6 shows another variant of the system 10 according to the present disclosure, which comprises a sliding perforator 72.

The perforator 72 forms a cylindrical ring which extends around the main axis A and which allows the passage of the second product 13.

The perforator 72 has a beveled upper edge 76 which is provided to perforate the sealing cap 30 of the base 26 inlet orifice 28, a lower segment 78 which is provided to penetrate into the cartridge 32 injection orifice 38, and an intermediate annular collar 80 which extends around the perforator 72.

In addition, the perforator 72 comprises a claw 82 which extends from an inner neck 83 arranged inside the perforator 72 and which is adapted to perforate a cap 84 which seals the cartridge 32 injection orifice 38.

The base 26 inlet orifice 28 forms a cylindrical cage in which the perforator 72 is slidably mounted axially between an upper seat 86 and a lower seat 88 formed by the base 26 inlet orifice 28.

Thus, when the cartridge 32 is screwed on the base 26, the cartridge 32 injection orifice 38 penetrates into the perforator 72, the claw 82 pierces the cap 84 which seals the cartridge 32 injection orifice 38, the cartridge 32 injection orifice 38 bears on the neck 83 in order to push the perforator 72 upward, then the beveled upper edge 76 perforates the sealing cap 30 of the base 26 inlet orifice 28.

The present disclosure is given by way of a non-limiting example.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A system for mixing two cosmetic products, the system comprising:

a tubular bottle defining a first reservoir adapted to contain a first product to be mixed, the tubular bottle extending axially along a main axis from an upper end forming a distribution orifice to a lower end;

a base which seals the lower end of the tubular bottle and which comprises an inlet orifice communicating with the first reservoir, wherein the inlet orifice is sealed by a cap;

a tubular cartridge defining a second reservoir adapted to contain a second product to be mixed, the tubular cartridge extending axially along the main axis from an upper end forming an injection orifice for the second product to a lower end;

a retaining device adapted to retain the tubular cartridge on the tubular bottle in an injection position in which the first reservoir communicates with the second reservoir via the inlet orifice of the base and the injection orifice of the tubular cartridge;

a perforator having an upper edge adapted to perforate the cap when the tubular cartridge occupies the injection position, the perforator axially fixed to the tubular cartridge and extending from an upper end of the tubular cartridge above surmounting the injection orifice and the second reservoir of the tubular cartridge; and an injection device which seals the lower end of the tubular cartridge and is movably mounted axially between a low initial position and a high final position in order to push the second product through the injection orifice of the tubular cartridge from the second reservoir to the first reservoir.

2. The system according to claim 1, wherein the base has a cylindrical shape along the main axis, from an upper end to a lower end and is sealingly mounted on the lower end of the tubular bottle.

3. The system according to claim 1, wherein the base is internal to the tubular bottle.

4. The system according to claim 2, wherein the cap is disposed at the upper end of the base.

5. The system according to claim 1, wherein the retaining device comprises a thread which extends around the main axis and which is formed on an outer face of the tubular cartridge, and a complementary tapping which is formed on an inner face of the base.

6. The system according to claim 5, wherein the lower end of the tubular cartridge includes a drive ring secured in movement to the tubular cartridge and which is provided to allow a user to screw the tubular cartridge on the base of the tubular bottle.

7. The system according to claim 6, wherein the drive ring is a breakable ring which is connected to the tubular cartridge by a plurality of radial retaining lugs which are mechanically weakened such that, after screwing the tubular cartridge, the user can exert a torque on the drive ring which ruptures the retaining lugs and disengages the drive ring from the tubular cartridge.

8. The system according to claim 1, wherein the perforator has a shape of a beveled cylindrical segment which extends around the main axis and which is arranged on the upper end of the tubular cartridge to perforate the cap which seals the inlet orifice of the base.

9. The system according to claim 1, wherein the injection device is a piston.

10. The system according to claim 9, wherein the piston is slidably mounted axially between the low initial position and the high final position in order to push the second product through the injection orifice of the tubular cartridge from the second reservoir to the first reservoir.

11. The system according to claim 1, wherein the tubular cartridge comprises a check valve which is associated with the injection orifice of the tubular cartridge in order to avoid unintentional flow of the second product contained in the tubular cartridge.

12. The system according to claim 1 further comprising a removable plug adapted to seal the tubular cartridge.

13. The system according to claim 1, wherein the distribution orifice of the tubular bottle includes a distribution device adapted to distribute the first product and the second product mixed in the first reservoir.

* * * * *